United States Patent [19]

Kawashima et al.

[11] Patent Number: 4,867,649

[45] Date of Patent: Sep. 19, 1989

[54] REFRIGERATING SYSTEM

[75] Inventors: Kenichi Kawashima, Katsuta; Atsushi Suginuma, Mito; Yukio Takahashi, Katsuta; Kenji Tojo; Kunihiko Takao, both of Ibaraki, all of Japan

[73] Assignee: Hitachi, Ltd., Tokyo, Japan

[21] Appl. No.: 941,838

[22] Filed: Dec. 15, 1986

[30] Foreign Application Priority Data

May 23, 1986 [JP] Japan ..... 61-117322

[51] Int. Cl.[4] ..... F04B 1/26

[52] U.S. Cl. ..... 417/222 S; 417/270

[58] Field of Search ..... 417/222, 270; 62/226, 62/228.3, 228.5, 209

[56] References Cited

U.S. PATENT DOCUMENTS

| | | | |
|---|---|---|---|
| 4,132,086 | 1/1979 | Kountz | 62/209 |
| 4,526,516 | 7/1985 | Swain | 417/270 |
| 4,533,299 | 8/1985 | Swain | 417/270 |
| 4,669,272 | 6/1987 | Kawai | 417/270 |
| 4,688,997 | 8/1987 | Susuki | 417/222 S |
| 4,691,526 | 9/1987 | Kobayaski | 417/295 |

FOREIGN PATENT DOCUMENTS

| | | | |
|---|---|---|---|
| 3545581 | 7/1986 | Fed. Rep. of Germany | 417/222 |
| 2153922A | 8/1985 | United Kingdom | 417/222 |
| 2155116A | 9/1985 | United Kingdom | 417/222 |

*Primary Examiner*—William L. Freeh

*Attorney, Agent, or Firm*—Antonelli, Terry & Wands

[57] ABSTRACT

A refrigeration system includes a variable-capacity compressor having a compression chamber for sucking and compressing a refrigerant and a crankcase surrounding a swash plate forming a drive portion for suction and compression, and a passage through which the refrigerant discharged from the outlet of the compression chamber passes at least through a condenser, an expansion means and an evaporator and is sucked into the inlet of the compression chamber of the compressor, the capacity of the compressor being changed by slanting the swash plate during its rotation. A pressure control device is provided in a refrigerant passage between the evaporator and the suction valve of the compressor whereby the pressure upstream thereof is controlled in such a manner that it does not decrease below a predetermined value, thereby preventing frosting of evaporator fins. A point partway along the passage upstream from the pressure control device and the crankcase of the variable-capacity compressor are communicated so that the capacity of the compressor may be controlled without controlling the pressure in the crankcase.

1 Claim, 8 Drawing Sheets

REFRIGERATING SYSTEM

BACKGROUND OF THE INVENTION

1. Field of the Invention

The present invention relates to a refrigeration system, and more particularly to a refrigerating system suitable for controlling the capacity of a capacity-variable compressor incorporated in a refrigeration system for use in an automobile air conditioner.

2. Prior Art

In a conventional refrigeration system incorporating a variable-capacity compressor, an axial-piston type of compressor has a mechanism in which a swash plate forming a drive portion for suction and compression can be rotated about a support point, and the angle of rotation of the swash plate around the support point, i.e., the piston stroke of the compressor, is controlled by modifying the pressure within a front cover enclosing the swash plate, i.e., the pressure within a crankcase so that the force acting on the rear surface of the piston is controlled, and by balancing that force and the gas compression force acting on the front surface of the piston. This capacity control method is, for example, disclosed in the specifications of U.S. Pat. Nos. 3,861,829 and 4,428,718. In such a system, the pressure in the crankcase is controlled by controlling the opening of a pressure control valve provided in a passage connecting the crankcase to the compressor suction chamber in such a manner that the pressure of a refrigerant sucked into the compressor remains above a predetermined value, thereby controlling the flow of blow-by gas (this method is disclosed in the specification of U.S. Pat. No. 3,861,829), and, in addition to this, by introducing the discharged refrigerant into the crankcase (this is proposed by U.S. Pat. No. 4,428,718). In the above-described methods, the capacity of the compressor is controlled by controlling the pressure in a large-capacity crankcase, inevitably resulting in a time lag in each control operation. In particular, changes in the capacity of the compressor do not conform to rapid changes in the rotational speed thereof.

Consequently, when a vehicle is running in a city, where acceleration and deceleration of the engine are repeated, the capacity of the compressor may become insufficient, resulting in insufficient cooling.

In addition, in the above methods, heat generated in the crankcase does not escape therefrom because the crankcase is of the enclosed type, deteriorating the viscosity of the lubricant and thereby reducing its lubricating effect.

SUMMARY OF THE INVENTION

In view of the above-mentioned disadvantages of the prior art, it is an object of the present invention to provide a refrigeration system which cools efficiently.

To achieve this object, according to the present invention, a pressure control device is provided in a refrigerant passage between an evaporator and a suction valve of a compressor so as to control the pressure upstream thereof so that it is not reduced below a predetermined value, thereby preventing the formation of ice on the evaporator fins. In addition, a point partway along the passage upstream from the pressure control device and the crankcase of a variable capacity compressor are connected to control the capacity of the compressor without controlling the pressure in the crankcase.

According to another embodiment of the present invention, the pressure control device is incorporated in the compressor body, thereby protecting it from damage due to contact with other devices and ensuring the stable operation thereof.

DESCRIPTION OF THE PREFERRED EMBODIMENTS

Figure 1:
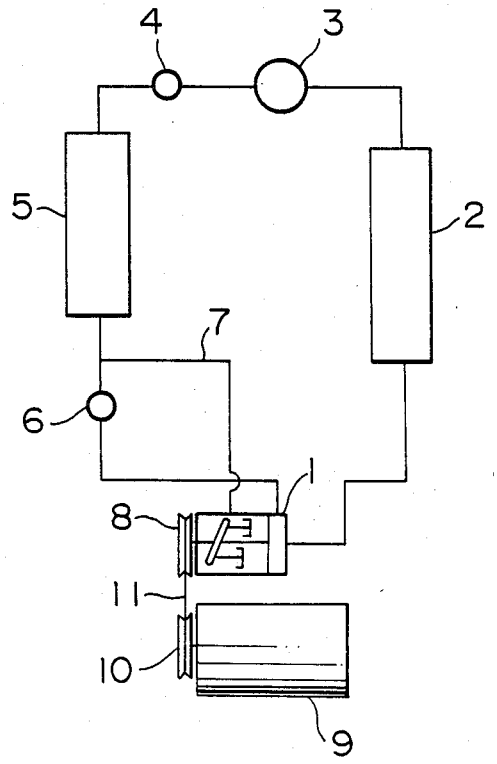
FIG. 1 illustrates the structure of an embodiment of a refrigeration system according to the present invention.
Figure 2:
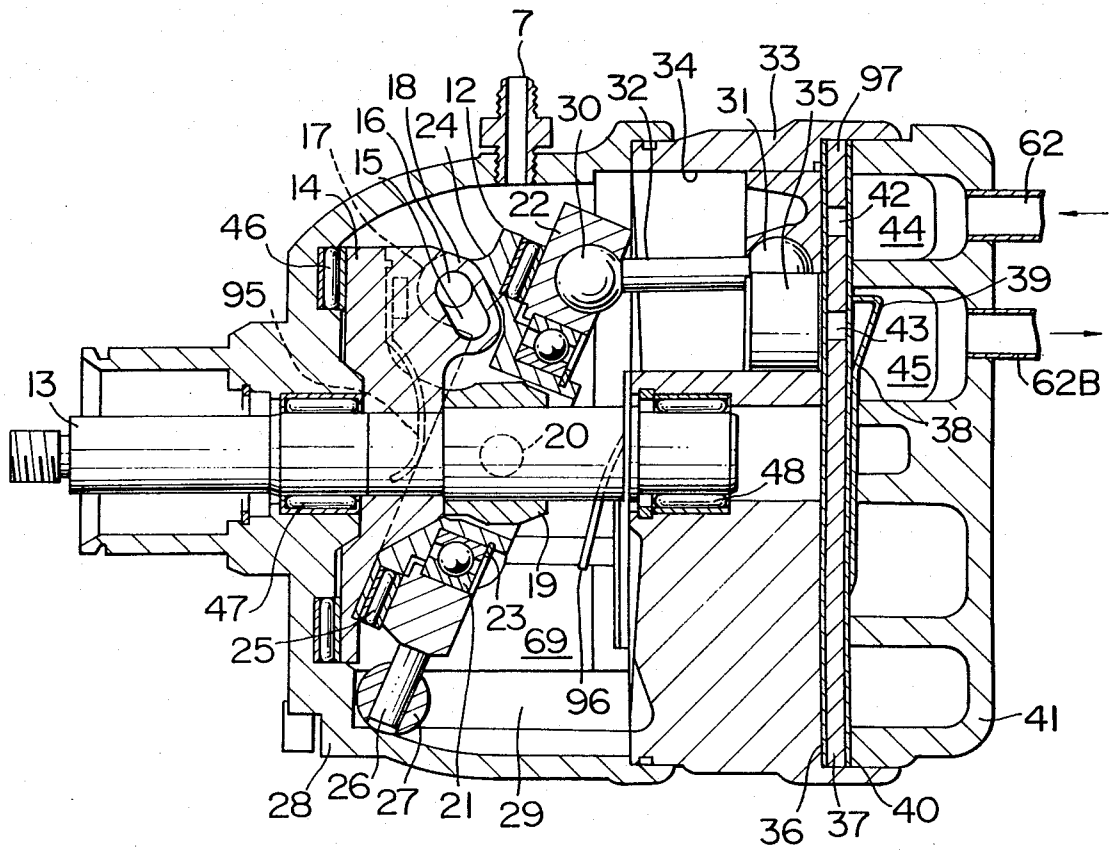
FIG. 2 is a cross-section through the capacity-variable compressor used in the present invention.

Embodiments of the present invention will be hereinunder described with reference to the accompanying drawings. Referring first to FIG. 1, which shows the structure of a refrigeration system to explain the concept of the present invention, a refrigeration system in general comprises a compressor 1, a condenser 2, a liquid receiver 3 (this need not be included in the system), an expansion means, e.g., an expansion valve 4, an evaporator 5 and piping connecting these elements. As shown in FIGS. 1 and 2, the refrigeration system of the present invention further includes a pressure control device 6 provided in the main piping between the outlet of the evaporator 5 and a low-pressure chamber 44 of the compressor 1 as well as a communicating tube connecting a part upstream of the pressure control device 6 and a crankcase 69 of the compressor 1. The compressor 1 is driven by an engine through a belt 11 extending between a compressor pulley 8 and a crank pulley 10 of the engine 9. FIG. 2 shows the structure of a first embodiment of the variable-capacity compressor incorporated in the present refrigeration system. It shows the compressor in a state in which a swash plate 12 of the compressor is rotating at its maximum angle of inclination, i.e., in which the piston stroke is maximum. The compressor 1 includes a drive plate 14 press-fitted onto a drive shaft 13 or secured thereto by a pin or the like. The drive plate 14 has a cam groove 15 in which a support pin 16 for supporting the swash plate 12 is inserted in such a manner that it is movable along a cam curve. The support pin 16 is simultaneously fitted into a gap in a cam plate lug 17. The surface of a drive plate lug 18 on which the cam groove 15 is provided is adapted to make contact with the surface of the cam plate lug 17 which is adjacent thereto in the rotational direction, so that torque is imparted from the lug 18 of the drive plate 14 to the lug 17 of the swash plate 12 to rotate it when the drive plate 14 rotates together with the drive shaft 13. The drive shaft 13 has a sleeve 19 assembled thereon in such a manner as to be slidable at least in the axial direction, on which the swash plate is supported by a pin 20 pivotally with respect to the sleeve. As a result, as the drive shaft 13 rotates, the drive plate 14, the swash plate 12 and the sleeve 19 rotate. The periphery of a cylindrical portion of the swash plate 12 is provided with a piston support 22 on a ball bearing 21. An inner race of the ball bearing is fixed by a snap ring 23 (C-clip) secured to the cylindrical portion via a groove so that it does not move in the axial direction. The rightward movement of the piston support 22, as viewed in the drawing, is regulated with respect to the bearing 21 by an annular protrusion 24 projecting inwardly; however, while the leftward movement thereof, as viewed in the drawing, is regulated by a needle thrust bearing 25 provided between a disk portion of the swash plate 12 and the cylindrical portion thereof. A guide pin 26 is press-fitted into the piston support in the radial direction thereof. The guide pin 26 has a slide ball 27 which enables the pin to rotate and slide. The movement of the guide pin 26 on the drive shaft is regulated by an axial groove 29 provided in the inner periphery of a front cover 28. A plurality of connecting rods 32 each having balls 30 and 31 at both ends thereof are pivotally disposed on the side of the piston support 22 which is opposite to the drive plate side. Each ball 31 has a piston 97 pivotally mounted thereon at the center thereof. The plurality of pistons 97 are positioned in a plurality of cylinders 34 provided in the cylinder block 33. The pistons 97 have a piston ring 35. The cylinder block 33 further includes a suction valve plate 36 provided with suction valves, a cylinder head 37, a discharge valve 38, packing 40 which also acts as a discharge valve support 39, and a rear cover 41. These elements are integrally secured by through bolts to the front cover 28 surrounding the drive plate 14, the swash plate 12 and the piston support 22. The cylinder head 37 is provided with suction ports 42 and discharge ports 43, each suction port and discharge port corresponding with each cylinder 34. Each suction port 42 communicates with a suction inlet 62 through a low-pressure chamber 44 of the rear cover 41, while each discharge port 43 communicates with a discharge outlet 62B through a high-pressure chamber 45. The low-pressure chamber 44 and the high-pressure chamber 45 in turn communicate with the evaporator 5 and the condenser 2, respectively. Thrust acting on the drive shaft 13 when gas is compressed is received by a thrust needle bearing 46 provided between the drive plate 14 and the front cover 28, while radial forces acting on the shaft are received by two radial needle bearing 47 and 48 provided in the front cover 28 and the cylinder block 33, respectively. The front cover 28 is provided with a communicating tube 7 which connects the crankcase 69 to the piping upstream of the pressure control device 6 shown in FIG. 1.

With the above-described arrangement, when the drive shaft 13 of the compressor 1 is driven by the engine, the drive plate 14 and the swash plate 12 thereby rotate while the piston support 22 pivots with respect to the shaft 13, except when the swash plate 12 is perpendicular to the shaft 13. This causes the connecting rods 32 to move back and forth in the cylinders 34, thereby sucking and compressing a refrigerant gas. The position at which the piston stroke is a maximum is regulated by placing the sleeve 19 in contact with the drive plate 14 while regulation of the minimum stroke position is effected by a snap ring 96 in a groove provided in the shaft 13. In the compressor shown in FIG. 2, a leaf spring is secured to the drive plate 14 by a screw or the like to soften the impact between the sleeve 19 and the drive plate 14, while the snap ring 96 acts as a spring which softens the impact of the sleeve 19 therewith. In this embodiment, the spring 96 which acts as a shock absorber when the angle of inclination of the swash plate is at a minimum is secured to the shaft 13. However, it may be fixed to the cylinder block 33 so as to regulate the movement of the piston support. In that case, a large amount of force will act on the snap ring 23 for the ball bearing 21, wearing the snap ring or the groove for the snap ring which is provided in the swash plate 12. However, this wear could be avoided by regulating the movement of the piston support.

The cam groove 15 constitutes a closed curve designed so that the top dead center of each piston remains at the same position even if the support pin 16 has moved within the cam groove.

Figure 3:
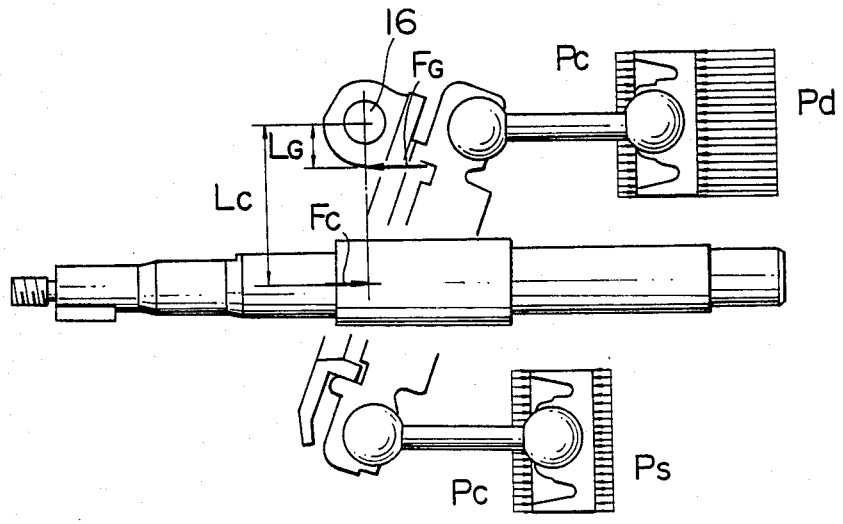
FIG. 3 illustrates the principle of controlling the capacity of the compressor of FIG. 2.
Figure 4:
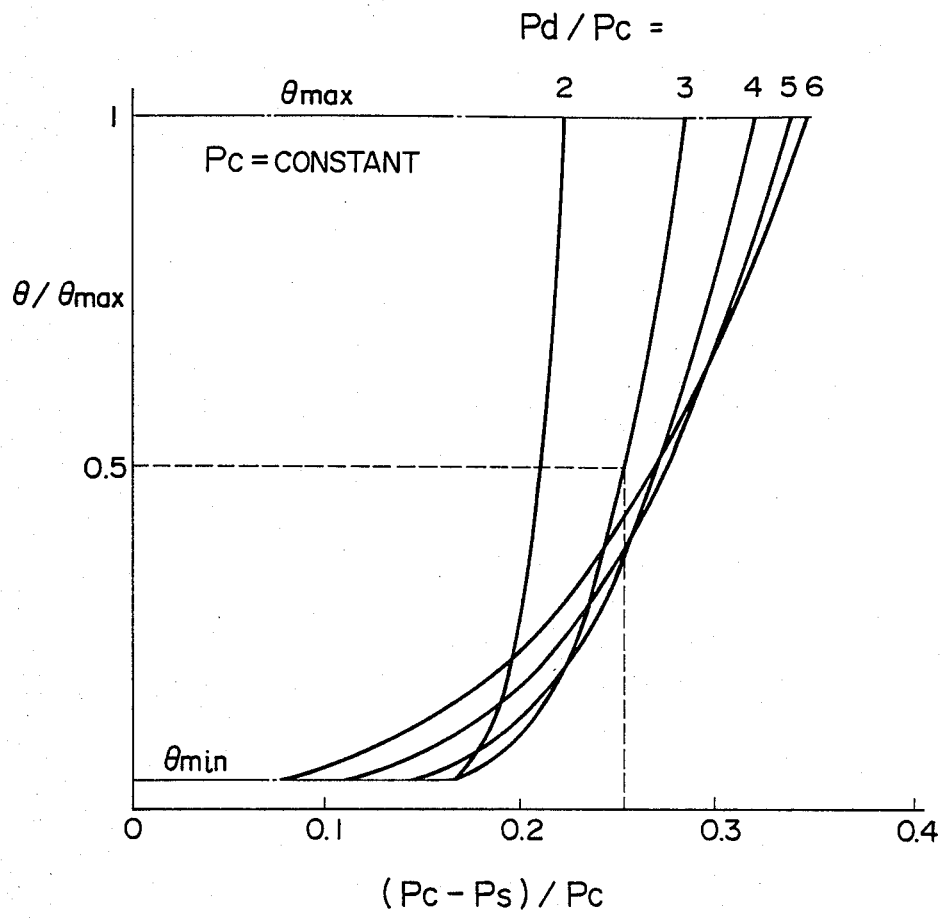
FIG. 4 shows the characteristics of the relationship between the angle of the inclination of the swash plate of the compressor during the rotation thereof and the pressures in the crankcase and of suction and discharge.

FIGS. 3 and 4 show the relationship between discharge pressure Pd of the compressor, suction pressure Ps of the compressor, internal pressure Pc of the crankcase and the angle of inclination $\theta$ of the swash plate during the rotation. In FIG. 3, supposing that the internal pressure of the crankcase is 0, if the moments about the support pin 16 when the swash plate is driven at a certain angle to the plane which is perpendicular to the axis of the drive shaft are balanced, they are expressed by the following equation:

$$Fg \times Lg + Fc \times Lc = 0,$$

where Fg is the resultant of the gas compression forces acting on the surfaces of the plurality of pistons; Lg is the distance from the center of the support pin 16 to the point of action of Fg; Fc is the resultant of the internal pressures of the crankcase acting on the rear surfaces of the pistons centered on the center of the drive shaft, assuming that the center of displacement of the pistons is identical to that of the drive shaft 13 and that the pistons are placed at equal pitches; and Lc is the distance between the center of the support pin 16 and the point of action of Fc.

FIG. 4 shows the results of experiments conducted by using the compressor of FIG. 2 in an attempt to obtain the angle of inclination $\theta$ of the swash plate during its rotation with respect to Pc minus the suction pressure Ps, using the discharge pressure Pd as parameter. In this case, Pc is constant, since, in the system shown in FIG. 1, the pressure control device 6 is maintaining the pressure on its upstream side constant and since Pc is made to be equal thereto. For example, it shows that the compressor is driven with the swash plate inclined at an angle of $\theta/\theta max = 0.5$ when the pressure difference, (Pc - Ps)/Pc, which is brought about by the pressure control device, is 0.25 when Pd/Pc=3.

Figure 5:
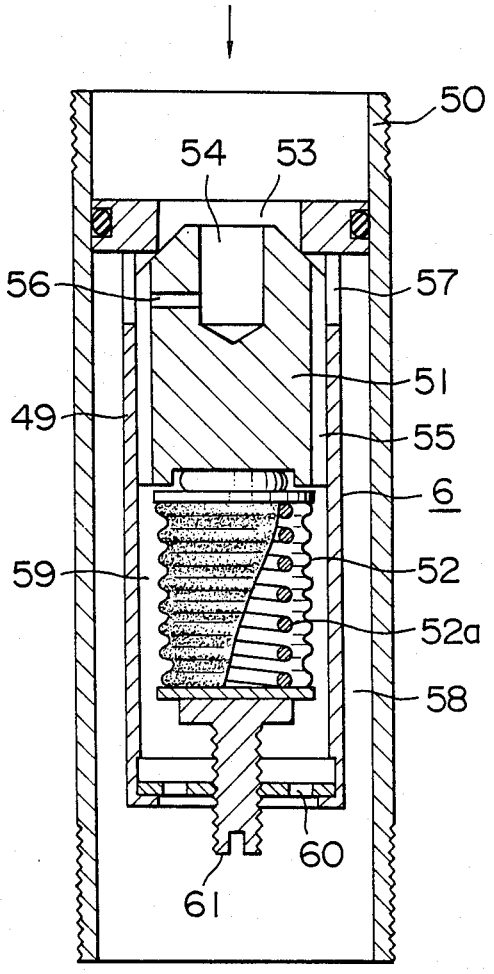
FIG. 5 is an enlarged cross-section through a pressure control device.

FIG. 5 shows the construction of the pressure control device 6. The pressure control device 6 has a cylindrical case 49 in piping 50, in which a piston 51 and a bellows 52 incorporating a spring **52*a* therein are housed. The drawing shows the device 6 in a state wherein the piston 51 is located at its uppermost position, closing a refrigerant inlet 53 in the case 49. The piston 51 has a recess 54 in the side thereof which is adjacent to the refrigerant inlet 53, as well as at least one groove 55 extending in the axial direction on the outer periphery thereof, the recess 54 and the groove 55 communicating with each other through a small hole 56. The case 49 has a refrigerant outlet 57 at an upper position thereof. The space between the outer periphery of the case 49 and the inner periphery of the piping 50 constitutes a passage 58 for passing a refrigerant therethrough. The space between the inner periphery of the case 49 and the outer periphery of the bellows 52 forms a refrigerant flow passage 59, which communicates with the piping located downstream of the pressure control device 6 through a refrigerant outlet 60 provided on the bottom of the case 49. The bellows 52 has at its lowest position means 61 for adjusting a preset pressure. The outer periphery of the means is threaded, whereby the position of the bottom of the bellows 52 can be adjusted with respect to the bottom of the case 49. The pressure control device is operated as follows: when the pressure upstream of the device is higher than the set pressure, the fluid pressure is propagated to the outer periphery of the bellows 52 through the piston recess 54 and the groove provided on the outer periphery of the piston, contracting the piston. As a result, the piston is pushed in the downward direction, as viewed in FIG. 5, providing an opening for the flow of the refrigerant between the refrigerant inlet 53 of the case 49 and the piston 51. If the pressure upstream of the pressure control device drops because of a reduction in the heat load or an increase in the compressor's rotational speed, the pressure is propagated through the refrigerant outlet 60 in the bottom of the case 49, lowering the pressure around the bellows 52 and expanding it. As a result, the piston 51 is moved upward, making the flow passage between the piston 51 and the refrigerant outlet 53 of the case 49 narrower and thereby raising the pressure upstream of the piston 51. The piston repeats this operation until the pressure upstream thereof becomes equal to the set value, at which position the movement of the piston is stopped. When the piston stroke is small, the pressure downstream of the pressure control device 6** becomes lowered, and the smaller the piston stroke (the smaller the refrigerant flow passage area), the lower the pressure downstream of the pressure control device becomes.

The preset pressure of the pressure control device will be 1.8 to 1.9 kg/cm$^2$g if the evaporation pressure of the evaporator 5 is set to be at 2.0 to 2.1 kg/cm$^2$g or higher and the pressure loss in the piping from the evaporator 5 to the pressure control device 6 is 0.1 to 0.2 kg/cm$^2$, although the pressure loss depends on the length of the piping. In this case, it is necessary to set the evaporation pressure to the above-mentioned value if the temperature at which the refrigerant is evaporated within the evaporator 5 is to be 0° C. or above and if dichloro-difluoro methane (R-12) is employed as the refrigerant. The suction pressure of the compressor (suction pressure in the cylinder), Ps, is determined by the pressure loss occurring downstream of the pressure control device. Because a part upstream of the pressure control device and the crankcase are connected by the communicating tube 7, the crankcase pressure, Pc, is also 1.8 to 1.9 kg/cm$^2$g. Assuming that it is 1.9 kg/cm$^2$g and that the pressure loss occurring downstream of the pressure control device is 0.5 kg/cm$^2$, Ps=1.4 kg/cm$^2$g. The angle of inclination $\theta$ of the swash plate when Ps=1.4 kg/cm$^2$g is obtained from FIG. 4 as $\theta/\theta$ max=0.43 (assuming that Pd/Pc=6). However, as the capacity of the compressor falls, Ps increases while Pd decreases. The angle of inclination $\theta$ of the swash plate during its rotation is therefore fixed at a value which satisfies all of these pressure conditions in the actual operation of the refrigeration system.

As described above, in accordance with the present invention, the angle of inclination of the swash plate during its rotation is determined by the pressure loss occurring downstream of the pressure control device, without controlling the pressure of the large capacity crankcase. Consequently, the angle of inclination of the swash plate during its rotation can be changed quickly to correspond to changes in the cycle operational conditions.

The frictional heat generated in the driving mechanism is discharged together with the blow-by gas, and is not left therein, since the crankcase 69 communicates with the low-pressure chamber. As a result, the lubricant can maintain an adequate viscosity, thereby maintaining high mechanical efficiency for a long period of time.

In addition, since the pressure control can be performed at the low-pressure side to change the angle of inclination of the swash plate during its rotation, the effect thereof on the components can be reduced. This also makes sealing easy, thereby making the designing of the product easy and prolonging the life of sealing parts. This results in an increase in the reliability of products.

According to the present invention, it is also possible to control the angle of inclination of the swash plate during its rotation by virtue of the pressure difference brought about by the pressure control device, even when the temperature of the fresh air becomes 0° C. and the discharge pressure Pd thereby becomes 2.1 kg/cm$^2$g (when the temperature of the fresh air is low, the heat load of the refrigerating cycle lowers, making the discharge pressure substantially equal to the saturation pressure with respect to the temperature of the fresh air). More specifically, the minimum capacity of a compressor is generally set within its range of use thereof at 10 to 20 cc/rev in terms of lubrication. This means that the compressor is capable of sucking a refrigerant even when the temperature of the fresh air becomes 0° C. As is described above, the preset pressure of the pressure control device is between 1.8 and 1.9 kg/cm$^2$. When the compressor is operated with a capacity which is close to the minimum value and the temperature of the fresh air nears 0° C., the flow rate of the refrigerant decreases, thereby reducing the opening of the pressure control valve. Consequently, the difference in pressure at the points in advance of and beyond the pressure control device becomes large, for example, 2 to 2.5 kg/cm$^2$, resulting in reduction in the angle of inclination of the swash plate.

As is clear from the foregoing description, the present invention makes it possible to control the angle of inclination of the swash plate during its rotation directly without controlling the pressure of the large-capacity crankcase. Consequently, the capacity of the compressor can be controlled in conformity with rapid changes in the rotational speed of the engine.

Figure 6:
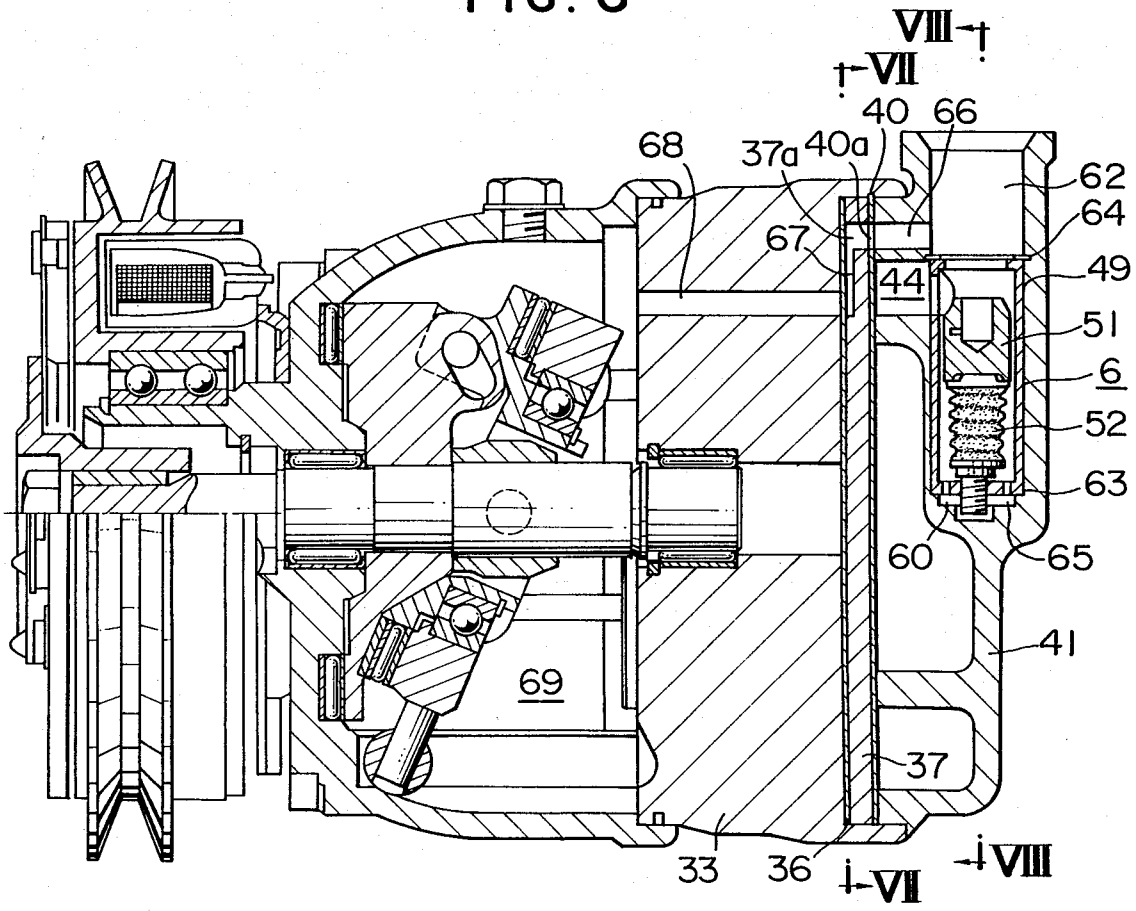
FIG. 6 is a cross-section through another embodiment of a compressor according to the present invention.
Figure 7:
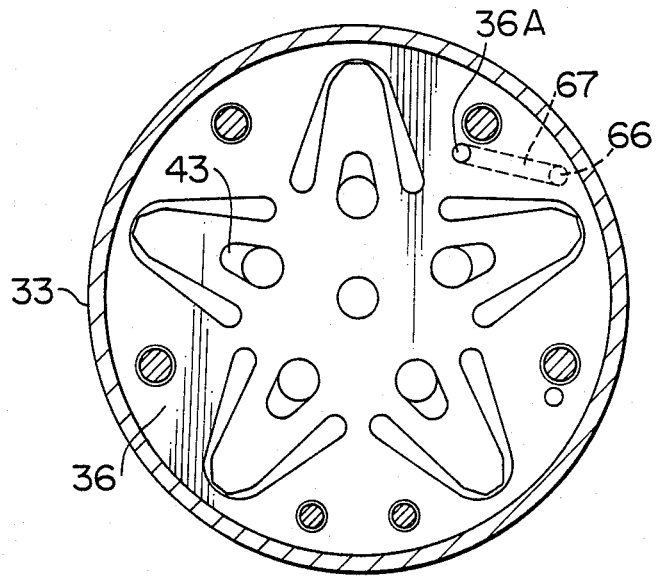
FIG. 7 is a cross-section taken along the line VII—VII of FIG. 6.
Figure 8:
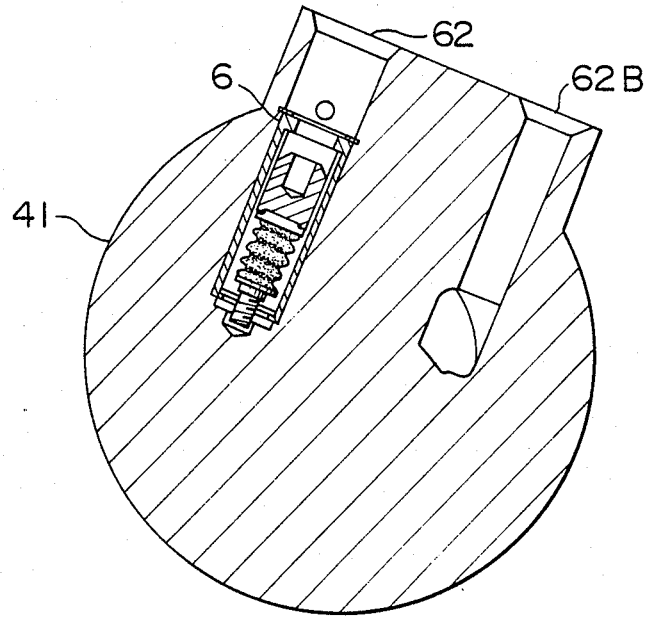
FIG. 8 is a cross-section taken along the line VIII—VIII of FIG. 6.

FIG. 6 shows another embodiment of the present invention which is different from the first one in that the pressure control device 6 and the communicating tube 7 are incorporated within the compressor shown in FIG. 2. In this embodiment, the springs 95, 96 shown in FIG. 2 need not be employed because their absence would make no difference in the function of the compressor.

More specifically, a hole is provided on the extension of the streamline of the refrigerant suction inlet 62 provided on the rear cover 41, into which the pressure control device 6 shown in FIG. 5 is inserted. The hole has a stepped portion 63 by means of which the bottom of the case of the pressure control valve is held, and houses a retaining ring 64 for regulating the movement of the case 49 in the axial direction. The drawing shows the pressure control device 6 in a state wherein the piston 51 is located at the lowest possible position. This is brought about when the pressure within the refrigerant suction inlet 62 and the low-pressure chamber 44 in the rear cover is higher than the preset pressure of the pressure control device and when the bellows 52 is thereby contracted. The rear cover has a recess 65 communicating with the refrigerant outlet 60 on the bottom of the case 49. The recess 65 also communicates with the low-pressure chamber 44 through a communicating passage (not shown). A small hole 66 which functions in the same manner as the communicating tube 7 shown in FIG. 1 is provided upstream of the pressure control valve to communicate the refrigerant suction inlet 62 with the crankcase 69 through a small hole 40*a* passing through the packing 40 and cylinder head 37, a groove 67 provided on the surface of the cylinder head which is adjacent to the suction valve plate, a through-hole 36*a* in the suction valve plate 36 and a small hole 68 formed between the cylinders in the cylinder block 33. In this embodiment, the pressure control device 6 is incorporated within the rear cover 44 of the compressor 1. This makes the provision of the piping connecting the cycle components easy. This also allows leakage of the refrigerant at the coupling portions to be reduced, thereby increasing the overall reliability. When the opening of the pressure control device becomes small and the pressure downstream thereof is thereby lowered, the amount of heat which invades the refrigerant can be reduced, ensuring stable control operation and increasing the cycle efficiency.

Figure 9:
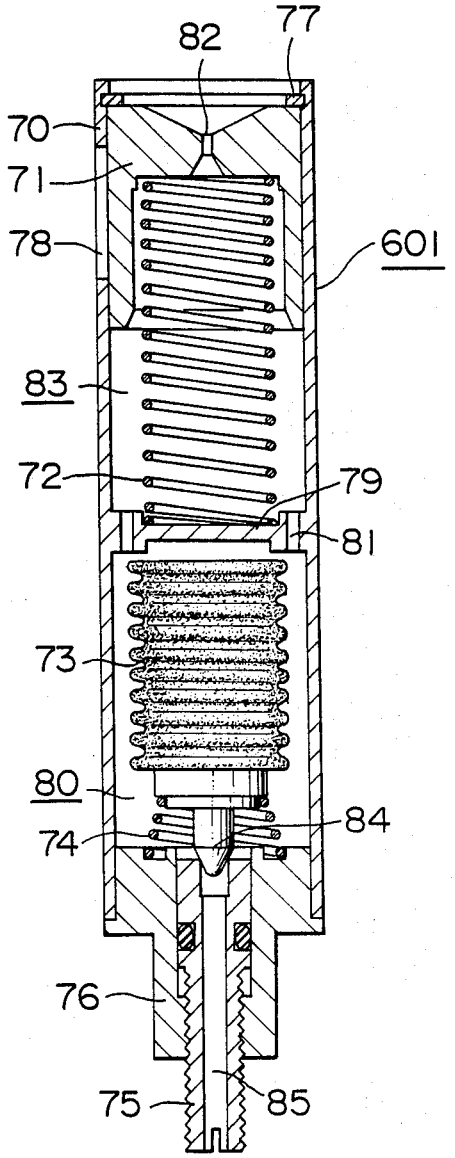
FIG. 9 is an enlarged cross-section through a modified pressure control device.

FIG. 9 shows a modification of the pressure control device. The device 601 has a case 70, a piston 71, a piston spring 72, a bellows 73, a bellows spring 74, adjusting means 75 and a case bottom member 76. The upper surface of the case is opened, and is provided with a retaining ring 77 for regulating the upper position of the piston 71 and a refrigerant flow port 78. A partition wall 79 is provided at the mid point of the case in the axial direction thereof to regulate the downward position of the piston spring 72 and the upward position of the bellows 73. The partition wall has a small hole 81 which allows a first void 83 between the piston spring and the case to communicate with a second void 80 between the bellows and the case. The case is fixed to the case bottom member 76 by press-fitting or other suitable method. The piston 71 is mounted in the case 70 in such a manner as to be slidable therein with a slight gap left between the piston and the case. The piston has a small hole 82 allowing the above of the piston to communicate with the first void 83. The interior of the bellows 73 may be evacuated. The bellows is so structured that it is deformed in a predetermined manner in accordance with the absolute value of the pressure around the bellows. The bellows is forced against the case partition wall 79 by the bellows spring 74 provided between the bellows 73 and the case bottom member 76. A valve body 84 is fixed to the bottom of the bellows and functions to open and close a throughhole provided in the adjusting means 75. The adjusting means 75 is screwed into the case bottom member, and the structure of the latter allows the pressure in the second void 80 which causes the valve body 84 to open and close the through hole 85 to be adjusted by turning this screw. The pressure control device 601 arranged in this way may be incorporated downstream of the refrigerant suction inlet 62 in the rear cover 41 in place of the pressure control device 6 constructed as shown in FIG. 5. The through-hole 85 in the adjusting means 75 communicates with the low-pressure chamber 44 in the rear cover 41. The operation of this pressure control device is as follows: when the piston is acting to close the refrigerant flow port 78 and when the pressure upstream of the piston is propagated into the second void through the small hole 82 so that the valve body 84 opens the through hole 85 (i.e., when the pressure upstream of the piston is higher than the preset pressure of the pressure control device), the pressure in the low-pressure chamber 44 in the rear cover 4 which has been lowered by the suction of the compressor is propagated into the first void 83 through the through hole 85, the second void 80 and the small hole in the partition wall, thus making the difference in pressure at the points in advance of and beyond the piston larger. Consequently, the piston is forced downward, thereby opening the refrigerant flow port 78 on the case 70. With the piston in this state, if the heat load is lowered or the rotational speed of the compressor increases, the pressure around the bellows will lower, thereby expanding it and inevitably closing the through-hole 85 when the pressure becomes lower than the preset pressure. This causes the difference in pressure at the points in advance of and beyond the piston to become equal. As a result, the piston 71 is pushed upward by the urging of the piston spring 72, reducing the area of the opening of the refrigerant flow port 78. In such a case, the difference in pressure at the points in advance of and beyond the pressure control device 601 becomes larger, and the angle of inclination of the swash plate during its rotation is accordingly changed on the basis of the characteristics shown in FIG. 4.

In this type of pressure control device 601, when the pressure upstream of the pressure control device becomes higher than the preset pressure of the device, the through-hole 85 is opened, and the piston 71 is forced to the lowermost position. This enables the pressure loss occurring at the pressure control device to be reduced.

What is claimed is:

1. A refrigeration system comprising a variable-capacity compressor having a compression chamber for sucking and compressing a refrigerant and a crankcase enclosing means as a front cover of said compressor and including a swash plate forming a drive portion for effecting suction and compression of the refrigerant, the capacity of said compressor being changed by the slanting of said swash plate while it is rotated; and a passage through which the refrigerant discharged from the outlet of said compressor flows through at least a condenser, an expansion means and an evaporator, and is then sucked in an inlet of said compressor located in a rear cover of the compressor; and a pressure control device incorporated within the rear cover of the compressor between the suction inlet in the rear cover of said compressor and the inlet of the compression chamber of said compressor and wherein a flow passage communicates the suction inlet in the rear cover at a point upstream of said pressure control device with said crankcase by way of a hole through the cylinder block of said compressor, the inclination of said swash plate is varied during its rotation by the difference between the pressure in said crankcase (Pc) and the suction pressure of said compression chamber (Ps), and a diameter of said flow passage is small as compared to that of the suction inlet in the rear cover of said compressor.

* * * * *